US006191747B1

(12) United States Patent
Cosenza

(10) Patent No.: US 6,191,747 B1
(45) Date of Patent: Feb. 20, 2001

(54) DUAL BAND ANTENNA

(75) Inventor: John M. Cosenza, St. James, NY (US)

(73) Assignee: Hirschmann Electronics, Inc., Pine Brook, NJ (US)

( * ) Notice: Under 35 U.S.C. 154(b), the term of this patent shall be extended for 0 days.

(21) Appl. No.: 09/056,018

(22) Filed: Apr. 7, 1998

(51) Int. Cl.[7] ..... H01Q 9/00
(52) U.S. Cl. ..... 343/749; 343/713; 343/715
(58) Field of Search ..... 343/713, 715, 343/722, 729, 749, 750, 745, 751, 850, 853, 860; H01Q 1/32

(56) References Cited

U.S. PATENT DOCUMENTS

| | | | | |
|---|---|---|---|---|
| 3,740,753 | | 6/1973 | Monola | 343/744 |
| 4,145,693 | | 3/1979 | Fenwick | 343/722 |
| 4,290,071 | | 9/1981 | Fenwick | 343/819 |
| 4,857,939 | * | 8/1989 | Shimazaki | 343/715 |
| 4,868,577 | * | 9/1989 | Wingard | 343/713 |
| 4,939,524 | * | 7/1990 | Blaese | 343/715 |
| 4,967,202 | * | 10/1990 | Shinnai et al. | 343/713 |
| 5,258,765 | * | 11/1993 | Dorrie et al. | 343/722 |
| 5,481,271 | | 1/1996 | Hai et al. | 343/749 |
| 5,543,808 | | 8/1996 | Feigenbaum et al. | 343/727 |
| 5,565,877 | * | 10/1996 | Du et al. | 343/715 |
| 5,898,408 | * | 4/1999 | Du | 343/715 |

* cited by examiner

*Primary Examiner*—Tho Phan
(74) *Attorney, Agent, or Firm*—Klauber & Jackson

(57) ABSTRACT

In one preferred embodiment, a dual band antenna having a radiating element which includes: a one-quarter PCS wavelength radiating portion which serves as a base; a one-half PCS wavelength radiating portion; a PCS phasing coil joining the one-quarter PCS wavelength radiating portion to the one-half PCS wavelength radiating portion, wherein the PCS phasing coil substantially allows energy in the AMPS band to pass therethrough; a one-half AMPS wavelength radiating portion; and an AMPS phasing coil joining the one-half AMPS wavelength radiating portion to the one-half PCS wavelength radiating portion, wherein the AMPS phasing coil substantially prevents energy in the PCS band from passing therethrough, and wherein the AMPS phasing coil provides a 180 degree phase shift for energy in the AMPS band. Thus, the one-quarter PCS and the one-half PCS wavelength radiating portions together behave as a one-quarter wavelength radiating sub-element for energy in the AMPS band, and the radiating element behaves as a one-half wavelength over one-quarter wavelength radiating element in the AMPS band. Furthermore, the one-half AMPS wavelength radiating portion is substantially inactive in the PCS band, such that the one-half PCS and the one-quarter PCS wavelength radiating portions behave as a one-half wavelength over one-quarter wavelength radiating element in the PCS band.

14 Claims, 5 Drawing Sheets

DUAL BAND ANTENNA

FIELD OF THE INVENTION

The present invention relates to dual band antennas generally and, more particularly, but not by way of limitation, to a novel dual band on-glass antenna which is suitable for simultaneously broadcasting in the PCS and AMPS bands.

BACKGROUND OF THE INVENTION

In a preferred embodiment, the present invention concerns a dual band antenna that can provide simultaneous performance in two separate frequency bands. In a particularly preferred embodiment, the dual band antenna of the present invention provides mobile cellular function in both the AMPS (806–890 MHz) and PCS (1850–1990 MHz) frequency bands. Preferably, the antenna is an on-glass style in which energy is directed along a coaxial cable to an on-glass coupler. The coupler transfers energy through the glass of a vehicle, such as an automobile or a truck, to an external radiating element. The radiating element preferably distributes the energy throughout space in a desired radiation pattern. Preferably, the radiating element is designed to provide omni-directional coverage in azimuth.

Known single band mobile cellular antennas can be classified into two categories based upon the gain that they provide.

As shown in FIG. 1, a short, one quarter wavelength stub provides 0 dBd when installed.

As seen in FIG. 2, to increase the antenna gain further, a phasing coil is typically added above the quarter wavelength section. A ½ to $\frac{5}{8}^{th}$ wavelength long section of wire is then added above the phasing coil. The phasing coil provides a 180 degree phase shift in the current distribution causing the upper and lower sections radiate constructively. Gain is increased to 3 dBd with this technique.

As illustrated in FIGS. 3 and 4, most dual band antennas also fall into two categories.

As seen in FIG. 3, the first category of known dual band antennas is based upon radiators that perform like ½ over ¼ wavelength antennas at high frequencies, while performing like ¼ wave antennas at low frequencies. This category of antenna provides 3 dBd gain in the high band but only 0 dB gain in the low band.

As seen in FIG. 4, a second category of known dual band antennas is based upon radiators that implement a coaxial choke. These radiators perform in a manner similar to a ¼ wave antenna at high frequencies, while performance at low frequencies is similar to a ½ wave over a ¼ wave antenna. This second category of antennas provides 0 dBd gain at high frequencies and 3 dBd gain at low frequencies.

Both categories of known dual band antennas provide 3 dBd gain in only one of the two frequency bands.

A principal object of the invention is to provide a dual band antenna capable of simultaneously performing in two separate and distinct bands. Another object is to provide a dual band on-glass antenna capable of simultaneously performing in two separate and distinct bands. A further object is to provide a dual band antenna which delivers 3 dBd of gain in two radiating bands simultaneously via a radiating element that electrically or electromagnetically appears as a ½ wavelength over a ¼ wavelength antenna in both bands.

It is yet another object of the present invention to provide a dual band antenna suitable for simultaneous performance in the PCS and AMPS bands.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in one preferred embodiment, a dual band antenna which includes a radiating element capable of performing simultaneously in first and second distinct bands. The radiating element includes: a one-quarter first wavelength radiating portion which serves as a base; a one-half first wavelength radiating portion for radiating energy in the first band; a first phasing coil joining the one-quarter first wavelength radiating portion to the one-half first wavelength radiating portion, wherein the first phasing coil substantially allows energy in the second band to pass therethrough; a one-half second wavelength radiating portion for radiating energy in the second band; and a second phasing coil joining the one-half second wavelength radiating portion to the one-half first wavelength radiating portion, wherein the second phasing coil substantially prevents energy in the first band from passing therethrough.

The one-quarter first and the one-half first wavelength radiating portions together behave as a one-quarter wavelength radiating sub-element for energy in the second band, whereby the radiating element behaves as a one-half wavelength over one-quarter wavelength radiating element in the second band. The one-half second wavelength radiating portion is substantially inactive in the first band, such that the one-half first and the one-quarter first wavelength radiating portions behave as a one-half wavelength-over-one-quarter wavelength radiating element in the first band.

In a particularly preferred embodiment, the first band substantially corresponds to the PCS band range, and the second band substantially corresponds to the AMPS band range.

In another preferred embodiment, the present invention provides a dual band on-glass antenna for use on a glass pane having an inner surface and an outer surface. The glass pane may be that found, for example, on a windshield of a vehicle. The antenna comprises: an on-glass coupler means for attaching the antenna to the glass pane and for transferring energy through the glass pane, the on-glass coupler means including an inner coupler mounted on the inner surface of the glass pane and an outer coupler mounted on the outer surface of the glass pane; radiating means for simultaneously, spatially distributing energy in first and second frequency bands which is received from the on-glass coupler means, wherein the first and second frequency bands are distinct from each other, the radiating means being attached to the outer coupler and disposed on the outer side of the glass pane; and connection means disposed on the inner side of the glass pane for delivering energy to the on-glass coupler means. In a preferred specific embodiment, the dual band on-glass antenna is adapted to provide a gain of up to approximately 3 dB in both of the bands simultaneously.

The radiating means preferably comprises a radiating element including: a one-quarter first wavelength radiating portion attached to the outer coupler for radiating energy in the first band; a one-half first wavelength radiating portion for radiating energy in the first band; a first phasing coil joining the one-quarter first wavelength radiating portion to the one-half first wavelength radiating portion, wherein the first phasing coil substantially allows energy in the second band to pass therethrough; a one-half second wavelength radiating portion for radiating energy in the second band;

and a second phasing coil joining the one-half second wavelength radiating portion to the one-half first wavelength radiating portion, wherein the second phasing coil substantially prevents energy in the first band from passing therethrough.

The one-quarter first and the one-half first wavelength radiating portions together behave as a one-quarter wavelength radiating sub-element for energy in the second band, whereby the radiating element behaves as a one-half wavelength over one-quarter wavelength radiating element in the second band. The one-half second wavelength radiating portion is substantially inactive in the first band, such that the one-half first and the one-quarter first wavelength radiating portions behave as a one-half wavelength over one-quarter wavelength radiating element in the first band.

In a particularly preferred embodiment, the radiating means comprises a radiating element which includes: a one-quarter PCS wavelength radiating portion attached to the outer coupler; a one-half PCS wavelength radiating portion; a PCS phasing coil joining the one-quarter PCS wavelength radiating portion to the one-half PCS wavelength radiating portion, wherein the PCS phasing coil substantially allows energy in the AMPS band to pass therethrough; a one-half AMPS wavelength radiating portion; and an AMPS phasing coil joining the one-half AMPS wavelength radiating portion to the one-half PCS wavelength radiating portion, wherein the AMPS phasing coil substantially prevents energy in the PCS band from passing therethrough. The one-quarter PCS and the one-half PCS wavelength radiating portions together behave as a one-quarter wavelength radiating sub-element for energy in the AMPS band, whereby the radiating element behaves as a one-half wavelength over one-quarter wavelength radiating element in the AMPS band. The one-half AMPS wavelength radiating portion is substantially inactive in the PCS band, such that the one-half PCS and the one-quarter PCS wavelength radiating portions behave as a one-half wavelength over one-quarter wavelength radiating element in the PCS band.

In yet another preferred embodiment, the present invention relates to a dual band antenna comprising a radiating element including: a one-quarter PCS wavelength radiating portion which serves as a base; a one-half PCS wavelength radiating portion; a PCS phasing coil joining the one-quarter PCS wavelength radiating portion to the one-half PCS wavelength radiating portion, wherein the PCS phasing coil substantially allows energy in the AMPS band to pass therethrough; a one-half AMPS wavelength radiating portion; and an AMPS phasing coil joining the one-half AMPS wavelength radiating portion to the one-half PCS wavelength radiating portion, wherein the AMPS phasing coil substantially prevents energy in the PCS band from passing therethrough, and wherein the AMPS phasing coil provides a 180 degree phase shift for energy in the AMPS band. The one-quarter PCS and the one-half PCS wavelength radiating portions together behave as a one-quarter wavelength radiating sub-element for energy in the AMPS band, whereby the radiating element behaves as a one-half wavelength over one-quarter wavelength radiating element in the AMPS band. The one-half AMPS wavelength radiating portion is substantially inactive in the PCS band, such that the one-half PCS and the one-quarter PCS wavelength radiating portions behave as a one-half wavelength over one-quarter wavelength radiating element in the PCS band.

The radiating element may be adapted to provide a gain of up to 3 dB in the PCS band. The radiating element may also be adapted to provide a gain of up to 3 dB in the AMPS band. In a particularly preferred embodiment, the radiating element is adapted to provide a gain of up to 3 dB in both the PCS and AMPS bands. The AMPS band is in the approximate range of 806–890 MHz, and the PCS is in the approximate range of 1850–1990 MHz.

The dual band antenna of the present invention may further comprise an on-glass coupler for mounting the radiating element to a glass pane, the coupler including an outer coupler for attachment to one side of the glass pane and an inner coupler for attachment to the other side of the glass pane, wherein the outer coupler is attached to the one-quarter PCS wavelength radiating portion.

In still another preferred embodiment, the present invention relates to a tuning network for use with a glass pane. The tuning network comprises: a dual band radiator capable of radiating energy in the PCS and AMPS bands simultaneously; an outer inductor in shunt with the dual band antenna; a coaxial input cable having an outer jacket and an inner wire; an inner inductor in shunt with the coaxial input cable; an inner capacitor in shunt with the coaxial input cable and the inner inductor; and an on-glass coupler including an outer coupler and an inner coupler, the inner and outer couplers being mounted on opposite sides of the glass pane, the outer coupler being connected in parallel with the dual band radiator and the outer inductor, the inner coupler being connected in parallel with the coaxial input cable, the inner inductor, and the inner capacitor, wherein the glass forms a series capacitor between the inner and outer couplers. The tuning network preferably provides a gain of up to approximately 3 dB in at least one of the bands. In a particularly preferred embodiment, the tuning network provides a gain of up to approximately 3 dB in both of the bands simultaneously.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
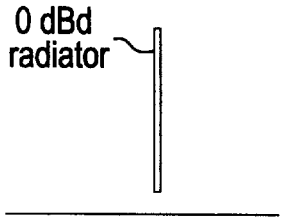
FIG.1 PRIOR ART
FIG. 1 is a known one quarter wavelength stub which provides 0 dBd.
Figure 2:
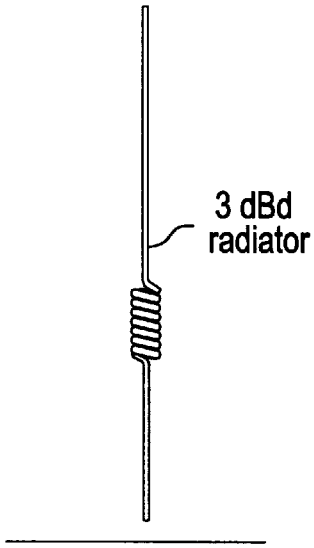
FIG.2 PRIOR ART
FIG. 2 illustrates a known phasing coil added above the quarter wavelength section of FIG. 1, wherein a ½ to $5/8^{th}$ wavelength long section of wire is added above the phasing coil to yield a 3 dB gain.
Figure 3:
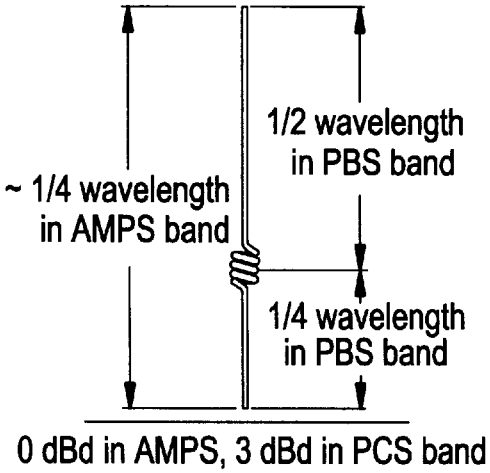
FIG.3 PRIOR ART
FIG. 3 illustrates a first category of known dual band antennas based upon radiators that perform like ½ over ¼ wavelength antennas at high frequencies, while performing like ¼ wave antennas at low frequencies, wherein 3 dBd gain is achieved in the high band but only 0 dB gain in the low band.
Figure 4:
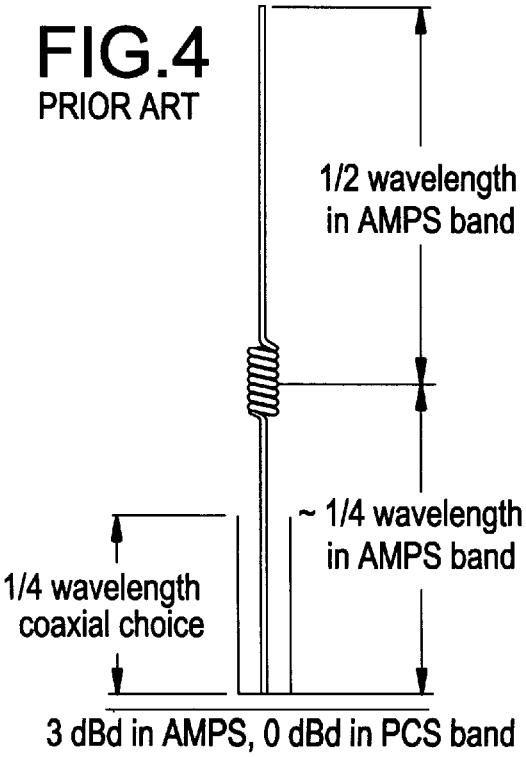
FIG.4 PRIOR ART
FIG. 4 illustrates a second category of known dual band antennas based upon radiators that implement a coaxial choke which perform in a manner similar to a ¼ wave antenna at high frequencies, while performance at low frequencies is similar to a ½ wave over a ¼ wave antenna, wherein 0 dBd gain at high frequencies and 3 dBd gain at low frequencies can be achieved.

In one preferred embodiment, the present invention comprises a dual band antenna which includes a radiating element capable of performing simultaneously in first and second distinct bands. The radiating element includes: a one-quarter first wavelength radiating portion which serves as a base; a one-half first wavelength radiating portion for radiating energy in the first band; a first phasing coil joining the one-quarter first wavelength radiating portion to the one-half first wavelength radiating portion, wherein the first phasing coil substantially allows energy in the second band to pass therethrough; a one-half second wavelength radiating portion for radiating energy in the second band; and a second phasing coil joining the one-half second wavelength radiating portion to the one-half first wavelength radiating portion, wherein the second phasing coil substantially prevents energy in the first band from passing therethrough.

The one-quarter first and the one-half first wavelength radiating portions together behave as a one-quarter wavelength radiating sub-element for energy in the second band, whereby the radiating element behaves as a one-half wavelength over one-quarter wavelength radiating element in the second band. The one-half second wavelength radiating portion is substantially inactive in the first band, such that the one-half first and the one-quarter first wavelength radiating portions behave as a one-half wavelength-over-one-quarter wavelength radiating element in the first band.

In a particularly preferred embodiment, the first band substantially corresponds to the PCS band range, and the second band substantially corresponds to the AMPS band range.

In another preferred embodiment, the present invention provides a dual band on-glass antenna for use on a glass pane having an inner surface and an outer surface. The glass pane may be that found, for example, on a windshield of a vehicle. The antenna comprises: an on-glass coupler means for attaching the antenna to the glass pane and for transferring energy through the glass pane, the on-glass coupler means including an inner coupler mounted on the inner surface of the glass pane and an outer coupler mounted on the outer surface of the glass pane; radiating means for simultaneously, spatially distributing energy in first and second frequency bands which is received from the on-glass coupler means, wherein the first and second frequency bands are distinct from each other, the radiating means being attached to the outer coupler and disposed on the outer side of the glass pane; and connection means disposed on the inner side of the glass pane for delivering energy to the on-glass coupler means.

The dual band on-glass antenna is preferably adapted to provide a gain of up to approximately 3 dB in at least one of the bands. In a preferred specific embodiment, the dual band on-glass antenna is adapted to provide a gain of up to approximately 3 dB in both of the bands simultaneously.

In a particular embodiment, the connection means is a coaxial cable.

The radiating means preferably comprises a radiating element including: a one-quarter first wavelength radiating portion attached to the outer coupler for radiating energy in the first band; a one-half first wavelength radiating portion for radiating energy in the first band; a first phasing coil joining the one-quarter first wavelength radiating portion to the one-half first wavelength radiating portion, wherein the first phasing coil substantially allows energy in the second band to pass therethrough; a one-half second wavelength radiating portion for radiating energy in the second band; and a second phasing coil joining the one-half second wavelength radiating portion to the one-half first wavelength radiating portion, wherein the second phasing coil substantially prevents energy in the first band from passing therethrough.

The one-quarter first and the one-half first wavelength radiating portions together behave as a one-quarter wavelength radiating sub-element for energy in the second band, whereby the radiating element behaves as a one-half wavelength over one-quarter wavelength radiating element in the second band. The one-half second wavelength radiating portion is substantially inactive in the first band, such that the one-half first and the one-quarter first wavelength radiating portions behave as a one-half wavelength over one-quarter wavelength radiating element in the first band.

In a particularly preferred embodiment, the first band substantially corresponds to the PCS band range, and the second band substantially corresponds to the AMPS band range.

Thus, in a particularly preferred embodiment, the radiating means is capable of simultaneous performance in the PCS band and the AMPS band.

In a particularly preferred embodiment, the radiating means comprises a radiating element which includes: a one-quarter PCS wavelength radiating portion attached to the outer coupler; a one-half PCS wavelength radiating portion; a PCS phasing coil joining the one-quarter PCS wavelength radiating portion to the one-half PCS wavelength radiating portion, wherein the PCS phasing coil substantially allows energy in the AMPS band to pass therethrough; a one-half AMPS wavelength radiating portion; and an AMPS phasing coil joining the one-half AMPS wavelength radiating portion to the one-half PCS wavelength radiating portion, wherein the AMPS phasing coil substantially prevents energy in the PCS band from passing therethrough. The one-quarter PCS and the one-half PCS wavelength radiating portions together behave as a one-quarter wavelength radiating sub-element for energy in the AMPS band, whereby the radiating element behaves as a one-half wavelength over one-quarter wavelength radiating element in the AMPS band. The one-half AMPS wavelength radiating portion is substantially inactive in the PCS band, such that the one-half PCS and the one-quarter PCS wavelength radiating portions behave as a one-half wavelength over one-quarter wavelength radiating element in the PCS band.

In yet another preferred embodiment, the present invention relates to a dual band antenna comprising a radiating element including: a one-quarter PCS wavelength radiating portion which serves as a base; a one-half PCS wavelength radiating portion; a PCS phasing coil joining the one-quarter PCS wavelength radiating portion to the one-half PCS wavelength radiating portion, wherein the PCS phasing coil substantially allows energy in the AMPS band to pass therethrough; a one-half AMPS wavelength radiating portion; and an AMPS phasing coil joining the one-half AMPS wavelength radiating portion to the one-half PCS wavelength radiating portion, wherein the AMPS phasing coil substantially prevents energy in the PCS band from passing therethrough, and wherein the AMPS phasing coil provides a 180 degree phase shift for energy in the AMPS band. The one-quarter PCS and the one-half PCS wavelength radiating portions together behave as a one-quarter wavelength radiating sub-element for energy in the AMPS band, whereby the radiating element behaves as a one-half wavelength over one-quarter wavelength radiating element in the AMPS band. The one-half AMPS wavelength radiating portion is substantially inactive in the PCS band, such that the one-half PCS and the one-quarter PCS wavelength radiating portions behave as a one-half wavelength over one-quarter wavelength radiating element in the PCS band.

The radiating element may be adapted to provide a gain of up to 3 dB in the PCS band. The radiating element may also be adapted to provide a gain of up to 3 dB in the AMPS band. In a particularly preferred embodiment, the radiating element is adapted to provide a gain of up to 3 dB in both the PCS and AMPS bands. The AMPS band is in the approximate range of 806–890 MHz, and the PCS is in the approximate range of 1850–1990 MHz.

The dual band antenna of the present invention may further comprise an on-glass coupler for mounting the radiating element to a glass pane, the coupler including an outer coupler for attachment to one side of the glass pane and an inner coupler for attachment to the other side of the glass pane, wherein the outer coupler is attached to the one-quarter PCS wavelength radiating portion.

In still another preferred embodiment, the present invention relates to a tuning network for use with a glass pane. The tuning network comprises: a dual band radiator capable of radiating energy in the PCS and AMPS bands simultaneously; an outer inductor in shunt with the dual band antenna; a coaxial input cable having an outer jacket and an inner wire; an inner inductor in shunt with the coaxial input cable; an inner capacitor in shunt with the coaxial input cable and the inner inductor; and an on-glass coupler including an outer coupler and an inner coupler, the inner and outer couplers being mounted on opposite sides of the glass pane, the outer coupler being connected in parallel with the dual band radiator and the outer inductor, the inner coupler being connected in parallel with the coaxial input cable, the inner inductor, and the inner capacitor, wherein the glass forms a series capacitor between the inner and outer couplers. The tuning network preferably provides a gain of up to approximately 3 dB in at least one of the bands. In a particularly preferred embodiment, the tuning network provides a gain of up to approximately 3 dB in both of the bands simultaneously.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

Figure 5:
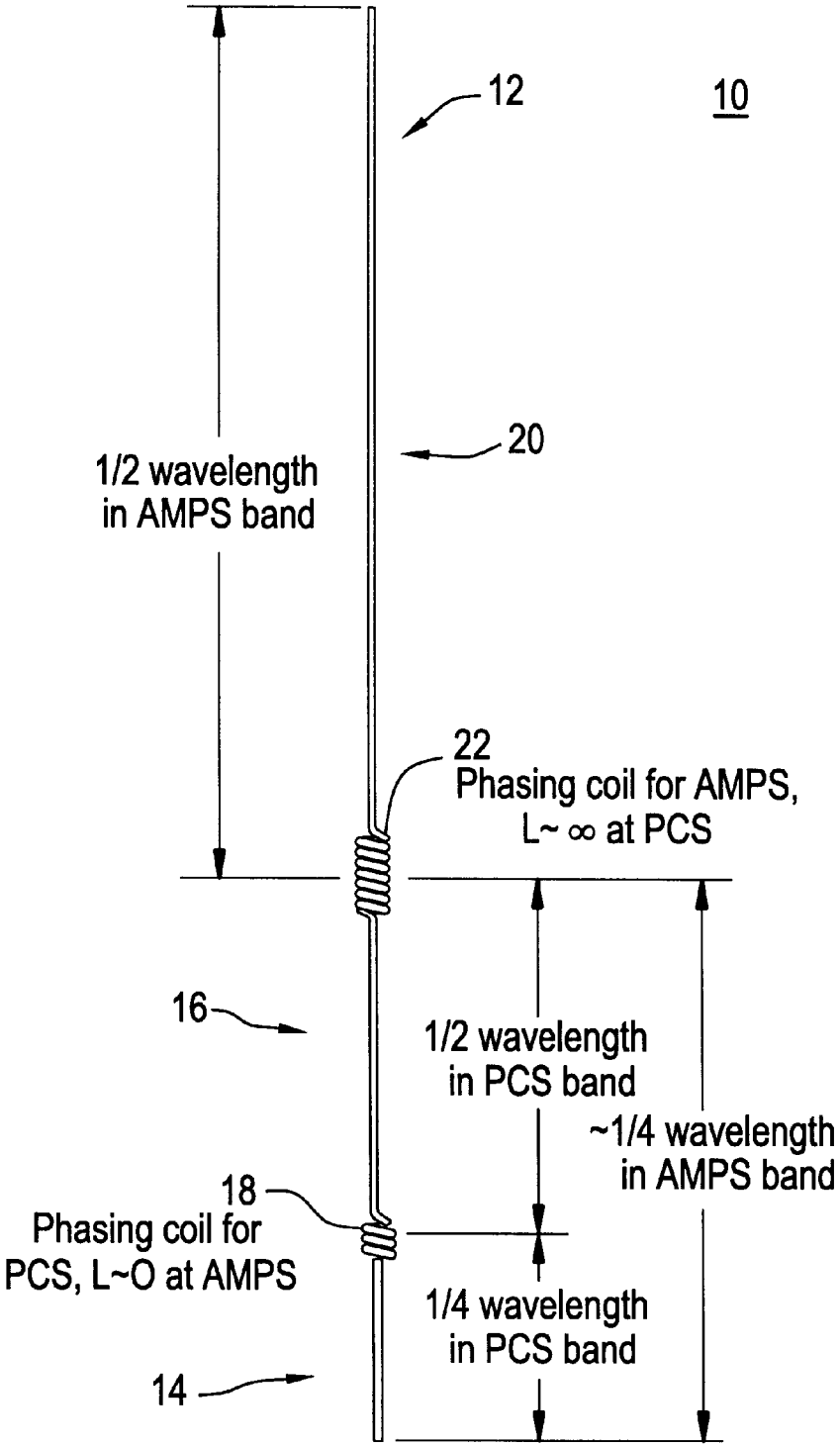
FIG. 5 schematically illustrates one preferred embodiment of a dual band antenna in accordance with the present invention.

FIG. 5 illustrates one preferred embodiment of a dual band antenna 10 in accordance with the present invention. The dual band antenna 10 comprises a radiator element 12 which includes a ¼ PCS wavelength portion 14 joined to a ½ PCS wavelength portion 16 by a PCS phasing coil or lower coil 18. The PCS phasing coil 18 is preferably constructed to minimize the inductance presented to energy in the AMPS frequency/wavelength band. Ideally, the inductance in the AMPS band would be zero, although in practical applications low levels of inductance can be tolerated so as to permit acceptable operation. The ½ PCS wavelength portion 16 is connected to a ½ AMPS wavelength portion 20 by an AMPS phasing coil or upper coil 22. The AMPS phasing coil 22 is preferably constructed to maximize the inductance presented to energy in the PCS frequency/wavelength band. Ideally, the inductance in the PCS band would be infinite, although in practical applications sufficiently high levels of inductance short of infinite inductance can be tolerated so as to permit acceptable operation. Thus, as described below, the present invention provides 3 dBd of gain in both radiating bands via a radiating element that electrically or electromagnetically appears as a ½ wavelength over a ¼ wavelength antenna in both bands simultaneously.

The inductive impedance of the lower coil 18 is preferably constructed to be insignificant in the low frequency band of operation (AMPS). At these lower frequencies, the antenna 10 behaves as a typical ½ wavelength over ¼ wavelength radiating element. The upper coil 22 provides the necessary 180 degree phase shift for AMPS current on the radiator and the upper and lower sections radiate constructively.

At higher frequencies (PCS), the inductive impedance of the upper coil 22 is preferably constructed to be large enough to prevent PCS currents from flowing to the upper section. This multi-turn coil 22 acts as a typical inductive choke. The effective aperture of the radiating element at PCS frequencies is hence limited to the region below this large coil 22. The radiating element below the large coil 22 is thus designed to appear as a ½ wavelength over a ¼ wavelength radiator at PCS frequencies. The lower coil 18 is designed to provide the necessary 180 degree phase shift at the higher frequencies, while not impacting the low frequency performance.

Typical known single band antennas are adjusted in length to achieve an impedance match over their band of operation. However, the dual band antenna 10 of the present invention is more complex. In practice, the upper coil 22 will not be a perfect open circuit at PCS frequencies, and the lower coil 18 will not be a perfect short circuit at AMPS frequencies. Furthermore, the radiation pattern performance is more critically related to the antenna dimensions, and impedance matching can be achieved in the upper and lower couplers for on-glass applications.

Figure 6:
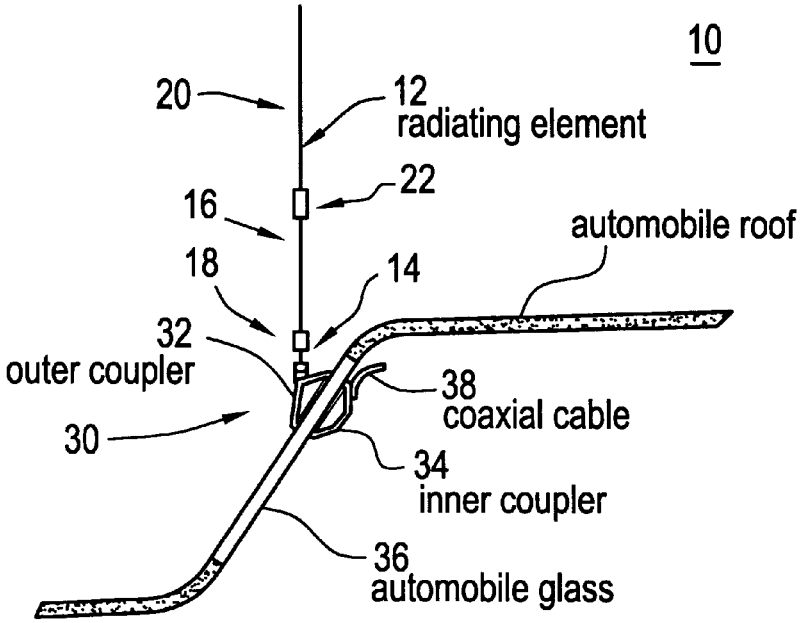
FIG. 6 schematically illustrates one preferred embodiment of a dual band on-glass antenna in accordance with the present invention.

FIG. 6 illustrates one preferred embodiment of a dual band on-glass antenna 10 in accordance with the present invention. A radiating element is attached to an onglass coupler means 30 which includes an outer coupler 32 and an inner coupler 34. The radiating element is attached to the outer coupler 32, which is attached or mounted to the outer surface of the glass pane 36 or windshield. The inner coupler 34 is correspondingly aligned with the outer coupler 32 on the opposite, inner surface of the glass pane 36 so as to enable transference of energy through the glass pane 36. A coaxial cable 38 disposed on the inside or inner surface of the glass pane 36 delivers the signal(s) to the inner coupler 34.

Figure 7:
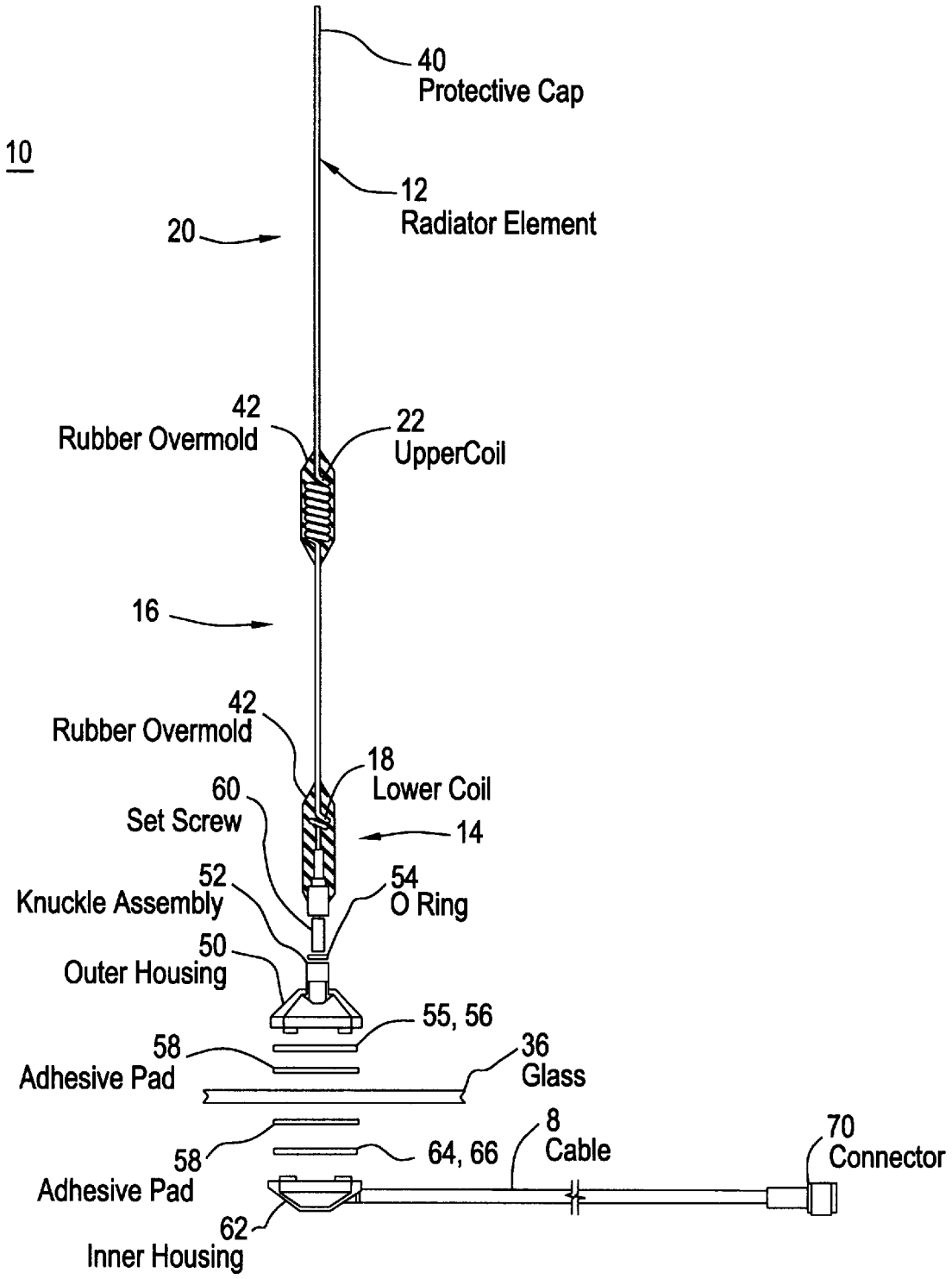
FIG. 7 schematically illustrates another preferred embodiment of a dual band on-glass antenna in accordance with the present invention.

FIG. 7 illustrates another preferred embodiment of a dual band on-glass antenna 10 in accordance with the present invention. A radiator element 12 is attached to an on-glass coupler assembly. The radiator element 12 includes a ¼ PCS wavelength portion 14 joined to a ½ PCS wavelength portion 16 by a PCS phasing coil or lower coil 18. The ½ PCS wavelength portion 16 is connected to a ½ AMPS wavelength portion 20 by an AMPS phasing coil or upper coil 22. A protective cap 40 may be disposed on the tip of the radiator element 12, i.e. on the tip of the ½ AMPS wavelength portion 20. The upper coil 22 may be encased in a rubber overmold or dielectric housing. Similarly, the lower coil 18 may be encased in a rubber overmold or other structural support.

Figure 8:
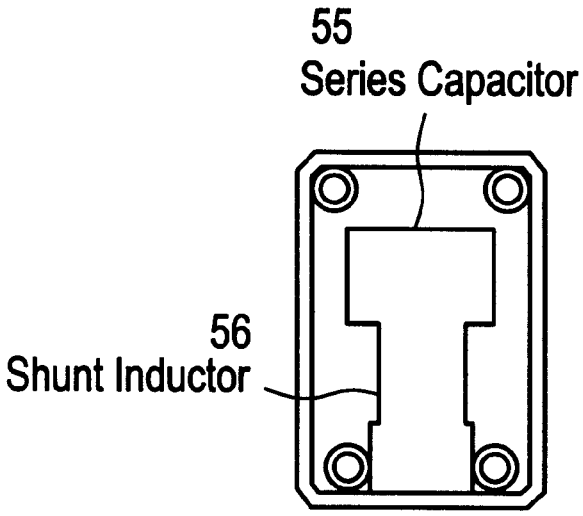
FIG. 8 shows the series capacitor and shunt inductor plate which is connected to the bottom surface of the outer housing of the outer coupler of the dual band on-glass antenna of FIG. 7.

The on-glass coupler assembly may comprise an outer coupler 32 for mounting the radiator element 12 to the outer surface of a glass pane 36 and an inner coupler 34 disposed on the inner surface of the glass pane 36. The outer coupler 32 comprises an outer housing 50, a knuckle assembly 52 disposed in the outer housing 50, and an O-ring 54 disposed between the knuckle assembly 52 and the lower end of the radiator element 12. A series capacitor 55 and shunt inductor plate 56, which is further illustrated in FIG. 8, is connected to the bottom surface of the outer housing 50. An adhesive pad 58 is sandwiched between the outer housing 50 and the outer surface of the glass in order to fixedly mount the outer coupler 32 to the glass 36.

The lower end of the ¼ PCS wavelength portion 14 may terminate in a set screw portion 60 which can releasably engage the knuckle assembly 52 of the outer coupler 32.

Figure 9:
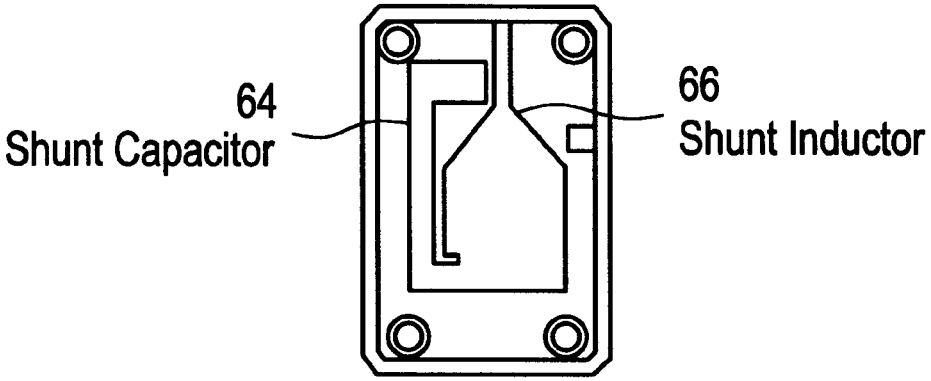
FIG. 9 shows the shunt capacitor and shunt inductor plate which is connected to the upper surface of the inner housing of the inner coupler of the dual band on-glass antenna of FIG. 7.

The inner coupler 34 comprises an inner housing 62 having an upper surface which faces toward the inner surface of the glass pane 36. A shunt capacitor 64 and shunt inductor plate 66, which is further illustrated in FIG. 9, is attached to the upper surface of the inner housing 62 of the inner coupler 34. An adhesive pad 58 is sandwiched between the inner housing 62 and the inner surface of the glass 36 in order to fixedly mount the inner coupler 34 to the glass 36.

A coaxial cable 38 is attached to the inner housing of the inner coupler 34, and the opposite end of the coaxial cable 38 may terminate in a connector 70 such as a mini-UHF or TNC connector for convenient releasable attachment to a desired communication device or other device.

FIG. 8 illustrates the series capacitor 55 and shunt inductor plate 56 which is connected to the bottom surface of the outer housing 50 of the outer coupler 32. The reactive elements may be realized with printed circuit technology resulting in a flat surface that may be adhesively attached to the glass surface.

FIG. 9 illustrates the shunt capacitor 64 and shunt inductor plate 66 which is connected to the upper surface of the inner housing 62 of the inner coupler 34. These reactive elements may also be realized with printed circuit technology.

Figure 10:
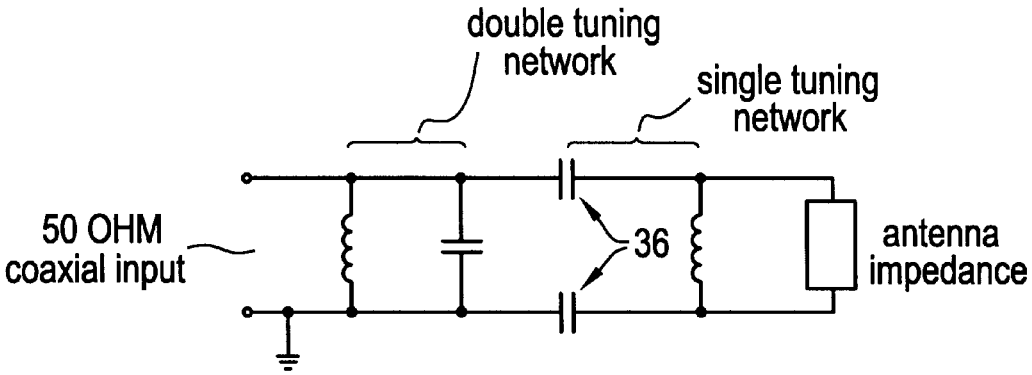
FIG. 10 is a schematic diagram of a matching circuit according to an embodiment of the present invention.

FIG. 10 presents a schematic diagram of a matching circuit according to another preferred embodiment of the present invention. The glass interface 36 forms the series capacitor shown in the diagram.

A schematic diagram of the tuning network according to the present invention, as implemented in FIGS. 8 and 9, is shown in FIG. 10. A key aspect to the circuit is the inductor in shunt with the antenna impedance. This can only be implemented if the ground capacitance through the glass is adequate. To ensure proper ground capacitance, the outer jacket of the coaxial cable 38 is preferably terminated to a metallic coating deposited within the inner coupler housing to provide an effective ground for the circuit above, and to provide some degree of shielding against coupler radiation. See U.S. Pat. No. 5,283,589, which is incorporated herein in its entirety, with regard to the inner coupler grounding.

The dual band antenna 10 of the present invention may be adapted to handle other combinations of electromagnetic bands, such as the European standard bands of 1710–1880 and 880–960 MHz, and as such, the present invention is not limited to accommodating the PCS and AMPS bands. Furthermore, some toleration may need to be exercised with regard to performance for signals or energy which vary from one-quarter wavelength or one-half wavelength.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A dual band antenna comprising a radiating element capable of performing simultaneously in first and second distinct bands, said radiating element including:

a one-quarter first wavelength radiating portion which serves as a base;

a one-half first wavelength radiating portion for radiating energy in the first band;

a first phasing coil joining said one-quarter first wavelength radiating portion to said one-half first wavelength radiating portion, wherein said first phasing coil substantially allows energy in the second band to pass therethrough;

a one-half second wavelength radiating portion for radiating energy in the second band; and a second phasing coil joining said one-half second wavelength radiating portion to said one-half first wavelength radiating portion, wherein said second phasing coil substantially prevents energy in the first band from passing therethrough;

whereby said one-quarter first and said one-half first wavelength radiating portions together behave as a one-quarter wavelength radiating sub-element for energy in the second band, whereby said radiating element behaves as a one-half wavelength over one-quarter wavelength radiating element in the second band; and whereby said one-half second wavelength radiating portion is substantially inactive in the first band, such that said one-half first and said one-quarter first wavelength radiating portions behave as a one-half wavelength over one-quarter wavelength radiating element the first band.

2. The dual band antenna according to claim 1 wherein the first band substantially corresponds to the PCS band range.

3. The dual band antenna according to claim 1 wherein the second band substantially corresponds to the AMPS band range.

4. A dual band antenna comprising a radiating element including:

a one-quarter PCS wavelength radiating portion which serves as a base;

a one-half PCS wavelength radiating portion;

a PCS phasing coil joining said one-quarter PCS wavelength radiating portion to said one-half PCS wavelength radiating portion, wherein said PCS phasing coil substantially allows energy in the AMPS band to pass therethrough;

a one-half AMPS wavelength radiating portion; and an AMPS phasing coil joining said one-half AMPS wavelength radiating portion to said one-half PCS wavelength radiating portion, wherein said AMPS phasing coil substantially prevents energy in the PCS band from passing therethrough, and wherein said AMPS phasing coil provides a 180 degree phase shift for energy in the AMPS band;

whereby said one-quarter PCS and said one-half PCS wavelength radiating portions together behave as a one-quarter wavelength radiating sub-element for energy in the AMPS band, whereby said radiating element behaves as a one-half wavelength over one-quarter wavelength radiating element in the AMPS band; and whereby said one-half AMPS wavelength radiating portion is substantially inactive in the PCS band, such that said one-half PCS and said one-quarter PCS wavelength radiating portions behave as a one-half wavelength over one-quarter wavelength radiating element in the PCS band.

5. The dual band antenna according to claim 4 wherein said radiating element is adapted to provide a gain of up to 3 dB in the PCS band.

6. The dual band antenna according to claim 4 wherein said radiating element is adapted to provide a gain of up to 3 dB in the AMPS band.

7. The dual band antenna according to claim 4 wherein said radiating element is adapted to provide a gain of up to 3 dB in both the PCS and AMPS bands.

8. The dual band antenna according to claim 4 wherein the AMPS band is in the approximate range of 806–890 MHz.

9. The dual band antenna according to claim 4 wherein the PCS is in the approximate range of 1850–1990 MHz.

10. The dual band antenna according to claim 4 further comprising an on glass coupler for mounting the radiating element to a glass pane, said coupler including an outer coupler for attachment to one side of the glass pane and an inner coupler for attachment to the other side of the glass pane, wherein said outer coupler is attached to said one-quarter PCS wavelength radiating portion.

11. A tuning network for use with a glass pane, said tuning network comprising:

a dual band radiator capable of radiating energy in the PCS and AMPS bands simultaneously;

an outer inductor in shunt with said dual band radiator;

a coaxial input cable having an outer jacket and an inner wire;

an inner inductor in shunt with said coaxial input cable;

an inner capacitor in shunt with said coaxial input cable and said inner inductor; and an on glass coupler including an outer coupler and an inner coupler, said inner and outer couplers being mounted on opposite sides of the glass pane, said outer coupler being connected in parallel with said dual band radiator and said outer inductor, said inner coupler being connected in parallel with said coaxial input cable, said inner inductor, and said inner capacitor, wherein the glass forms a series capacitor between said inner and outer couplers.

12. The tuning network according to claim 11 wherein said tuning network provides a gain of up to approximately 3 dB in at least one of the bands.

13. The tuning network according to claim 11 wherein said tuning network provides a gain of up to approximately 3 dB in both of the bands simultaneously.

14. A dual band on glass antenna for use on a glass pane having an inner surface and an outer surface, said antenna comprising:

an on glass coupler means for attaching said antenna to the glass pane and for transferring energy through the glass pane, said on glass coupler means including an inner coupler mounted on the inner surface of the glass pane and an outer coupler mounted on the outer surface of the glass pane;

a radiating element including:

a one-quarter first wavelength radiating portion attached to said outer coupler for radiating energy in the first band;

a one-half first wavelength radiating portion for radiating energy in the first band;

a first phasing coil joining said one-quarter first wavelength radiating portion to said one-half first wavelength radiating portion, wherein said first phasing coil substantially allows energy in the second band to pass therethrough;

a one-half second wavelength radiating portion for radiating energy in the second band; and a second phasing coil joining said one-half second wavelength radiating portion to said one-half first wavelength radiating portion, wherein said second phasing coil substantially prevents energy in the first band from passing therethrough;

whereby said one-quarter first and said one-half first wavelength radiating portions together behave as a one-quarter wavelength radiating sub-element for energy in the second band, whereby said radiating element behaves as a one-half wavelength over one-quarter wavelength radiating element in the second band; and whereby said one-half second wavelength radiating portion is substantially inactive in the first band, such that said one-half first and said one-quarter first wavelength radiating portions behave as a one-half wavelength over one-quarter wavelength radiating element in the first band; and connection means disposed on the inner side of the glass pane for delivering energy to said onglass coupler means.

* * * * *